US006474325B2

(12) United States Patent
Rice et al.

(10) Patent No.: US 6,474,325 B2
(45) Date of Patent: Nov. 5, 2002

(54) GAS REGULATOR

(75) Inventors: John Ronald Rice, Staffordshire (GB); Nicholas John Marks, Staffordshire (GB)

(73) Assignee: NPF Limited, Birmingham (GB)

( * ) Notice: Subject to any disclaimer, the term of this patent is extended or adjusted under 35 U.S.C. 154(b) by 0 days.

(21) Appl. No.: 09/859,883

(22) Filed: May 16, 2001

(65) Prior Publication Data

US 2002/0017286 A1 Feb. 14, 2002

Related U.S. Application Data

(63) Continuation-in-part of application No. 09/418,225, filed on Oct. 14, 1999, now abandoned, which is a continuation-in-part of application No. 09/272,652, filed on Mar. 18, 1999, now abandoned.

(30) Foreign Application Priority Data

Jan. 22, 1999 (GB) ..... 9901288
Jul. 19, 1999 (GB) ..... 9916814

(51) Int. Cl.[7] ..... F41B 11/00; F41B 11/32

(52) U.S. Cl. ..... 124/71; 124/70; 124/72; 124/73; 124/74; 124/75; 124/77

(58) Field of Search ..... 124/71, 70, 72, 124/73, 74, 75, 76, 77; 137/557, 558

(56) References Cited

U.S. PATENT DOCUMENTS

| | | | | |
|---|---|---|---|---|
| 762,274 A | | 6/1904 | Bourseau | 137/505.25 |
| 1,078,487 A | | 11/1913 | Dickey | 124/69 |
| 1,404,689 A | | 1/1922 | Fairweather | 124/69 |
| 1,512,022 A | | 10/1924 | Hendrickson | 137/552 |
| 2,097,866 A | | 11/1937 | Tomlinson | 124/15 |
| 2,594,240 A | | 4/1952 | Wells | 124/13 |
| 2,623,226 A | | 12/1952 | Jones et al. | 15/104.06 |
| 5,736,720 A | * | 4/1998 | Bell et al. | 235/1 B |
| 5,755,213 A | | 5/1998 | Gardner, Jr. et al. | 124/73 |
| 5,755,634 A | * | 5/1998 | Huang | 473/570 |
| 5,881,707 A | | 3/1999 | Gardner, Jr. | 124/77 |
| 5,947,738 A | * | 9/1999 | Muehle et al. | 124/57 |
| 5,957,119 A | | 9/1999 | Perry et al. | 124/73 |
| 5,967,133 A | | 10/1999 | Gardner, Jr. | 124/77 |
| 6,003,504 A | | 12/1999 | Rice et al. | 124/73 |
| 6,009,900 A | * | 1/2000 | Elgert et al. | 137/505 |
| 6,035,843 A | | 3/2000 | Smith et al. | 124/77 |
| 6,062,208 A | * | 5/2000 | Seefeldt et al. | 124/71 |
| 6,213,110 B1 | * | 4/2001 | Christopher et al. | 124/48 |
| 6,305,367 B1 | * | 10/2001 | Kotsiopoulos et al. | 124/49 |
| 6,311,682 B1 | * | 11/2001 | Rice et al. | 124/71 |

(List continued on next page.)

FOREIGN PATENT DOCUMENTS

| | | | |
|---|---|---|---|
| EP | 0440428 A2 | 8/1991 | |
| EP | 0467089 A2 | 1/1992 | |
| GB | 2066932 | 7/1981 | 138/505.39 |

OTHER PUBLICATIONS

"What an Angel" (article re Angel V6 Gear Special), PGI product catalog, Mar. 1997, pp. 74–75.

*Primary Examiner*—Charles T. Jordan
*Assistant Examiner*—Stephen A. Holzen
(74) *Attorney, Agent, or Firm*—Christie, Parker & Hale, LLP

(57) ABSTRACT

A gas regulator, relating in particular to a regulator for a gas or air cylinders, for supplying compressed air to a paintball gun or other compressed air powered projectile firing devices. A micro controller operably associated with the gas regulator is adapted to generate a shots remaining signal by receiving a pressure drop signal from a pressure transducer and a set of shot fired signals corresponding to the gas pressure drop signal. A method is also provided for generating the shots remaining signal using a second gas cylinder temperature signal, a temperature compensated shots remaining calibration constant and a gas regulator input pressure signal.

14 Claims, 7 Drawing Sheets

U.S. PATENT DOCUMENTS

| | | | | | |
|---|---|---|---|---|---|
| 2,635,599 | A | | 4/1953 | Wells | 124/13 |
| 2,747,607 | A | * | 5/1956 | Matasovic | 137/505.11 |
| 2,755,815 | A | | 7/1956 | Erle | 137/484.2 |
| 2,777,456 | A | | 1/1957 | Ey | 137/73 |
| 2,980,096 | A | | 4/1961 | Merz | 124/11 |
| 3,113,432 | A | | 12/1963 | Watson | 60/52 |
| 3,139,902 | A | | 7/1964 | Thomas | 137/557 |
| 3,250,292 | A | | 5/1966 | Mollick | 137/557 |
| 3,272,220 | A | | 9/1966 | Frania et al. | 137/116.5 |
| 3,612,026 | A | | 10/1971 | Webster | 124/11 |
| 3,824,981 | A | | 7/1974 | Crane et al. | 124/11 R |
| 3,972,345 | A | | 8/1976 | Court | 137/490 |
| 3,995,656 | A | | 12/1976 | Mills, Jr. | 137/497 |
| 4,064,899 | A | | 12/1977 | Lehmann | 137/269 |
| 4,181,139 | A | | 1/1980 | Martini | 137/68 |
| 4,219,017 | A | | 8/1980 | Shamlian | 128/204.26 |
| 4,226,257 | A | | 10/1980 | Trinkwalder | 137/81.2 |
| 4,230,140 | A | | 10/1980 | Hart | 137/81.2 |
| 4,304,213 | A | | 12/1981 | Jereckos | 124/69 |
| 4,349,043 | A | | 9/1982 | Christensen | 137/505.42 |
| 4,396,032 | A | | 8/1983 | Duchesne et al. | 137/81.2 |
| 4,527,582 | A | | 7/1985 | Buckle et al. | 137/81.2 |
| 4,602,608 | A | | 7/1986 | Lacam et al. | 124/74 |
| 4,616,622 | A | | 10/1986 | Milliman | 124/73 |
| 4,694,850 | A | | 9/1987 | Fumino | 137/318 |
| 4,770,153 | A | | 9/1988 | Edelman | 124/72 |
| 4,802,504 | A | | 2/1989 | Politi | 137/454.5 |
| 4,876,903 | A | * | 10/1989 | Budinger | 128/204.21 |
| 4,882,678 | A | * | 11/1989 | Hollis et al. | 128/201.27 |
| 4,924,904 | A | | 5/1990 | Carter | 137/505.11 |
| 4,936,282 | A | | 6/1990 | Dobbins et al. | 124/74 |
| 4,982,758 | A | | 1/1991 | Schlachter | 137/505.42 |
| 5,097,860 | A | | 3/1992 | Ferguson et al. | 137/78.1 |
| 5,113,898 | A | | 5/1992 | White et al. | 137/454.5 |
| 5,123,436 | A | | 6/1992 | Koechlein et al. | 137/12 |
| 5,125,653 | A | * | 6/1992 | Kovacs et al. | 124/78 |
| 5,137,026 | A | * | 8/1992 | Waterson et al. | 600/538 |
| 5,179,856 | A | * | 1/1993 | Huang | 338/42 |
| 5,184,609 | A | | 2/1993 | Hart | 128/205.24 |
| 5,265,582 | A | | 11/1993 | Bhogal | 124/73 |
| 5,280,778 | A | | 1/1994 | Kotsiopoulos | 124/73 |
| 5,379,761 | A | | 1/1995 | Schuler | 128/205.24 |
| 5,411,053 | A | | 5/1995 | Markham et al. | 137/505.28 |
| 5,494,024 | A | | 2/1996 | Scott | 124/73 |
| 5,522,421 | A | | 6/1996 | Holt et al. | 137/505.22 |
| 5,614,679 | A | * | 3/1997 | Johnson | 137/557 |
| 5,669,369 | A | | 9/1997 | Scott | 124/73 |
| 5,727,538 | A | * | 3/1998 | Ellis | 124/32 |

* cited by examiner

GAS REGULATOR

CROSS-REFERENCE TO RELATED APPLICATION(S)

This is a continuation-in-part of application Ser. No. 09/418,225, filed Oct. 14, 1999 now abandoned, which is a continuation-in-part of application Ser. No. 09/272,652, filed Mar. 18, 1999 now abandoned.

BACKGROUND OF THE INVENTION

This invention relates to a gas regulator. In particular, it relates to a regulator for a gas or air cylinder for supplying compressed air to a paintball gun or other compressed air powered projectile firing device.

Pneumatically operated paintball guns require a source of compressed air or other gas to function. This is generally provided by a portable gas cylinder which is mounted to the gun in operation.

A regulator is required to obtain the desired output pressure from a gas cylinder. Up to now, such regulators have been fairly crude devices, generally adapted from other uses. In particular, the ability of users to control the output pressure and to be able to control and to view the various parameters concerned with the output of the gas cylinder, has been severely limited.

The present invention arose in an attempt to provide an improved gas regulator.

SUMMARY OF THE INVENTION

In one aspect of the present invention, a gas regulator for a compressed gas powered projectile firing device is adapted to generate a shots remaining signal. The gas regulator comprises a pressure transducer operably coupled to a microcontroller. The microcontroller receives a gas pressure drop signal from the pressure transducer and a set of shot fired signals corresponding to the gas pressure drop signal. The microcontroller then generates a shots remaining calibration constant using the set of shot fired signals and the gas pressure drop signal. The microcontroller then receives a gas pressure signal from the pressure transducer and generates a shots remaining signal from the shots remaining calibration constant and the gas pressure signal.

In another aspect of the invention, a method is provided for generating a shots remaining signal for a compressed gas powered projectile firing device, the method comprises the steps of: receiving a gas regulator input pressure drop signal; receiving a set of shot fired signals corresponding to the gas regulator input pressure drop signal; receiving a first gas cylinder temperature signal corresponding to the gas regulator input pressure drop signal; generating a temperature compensated shots remaining calibration constant using the set of shot fired signals, the first gas cylinder temperature signal, land the gas regulator input pressure drop signal; receiving a gas regulator input pressure signal; receiving a second gas cylinder temperature signal corresponding to the gas regulator input pressure signal; and generating the shots remaining signal using the second gas cylinder temperature signal, the temperature compensated shots remaining calibration constant, and the gas regulator input pressure signal.

BRIEF DESCRIPTION OF THE DRAWINGS

Embodiments of the invention will now be described, by way of example only, with reference to the accompanying drawings, in which.

DETAILED DESCRIPTION OF THE INVENTION

Figure 1:
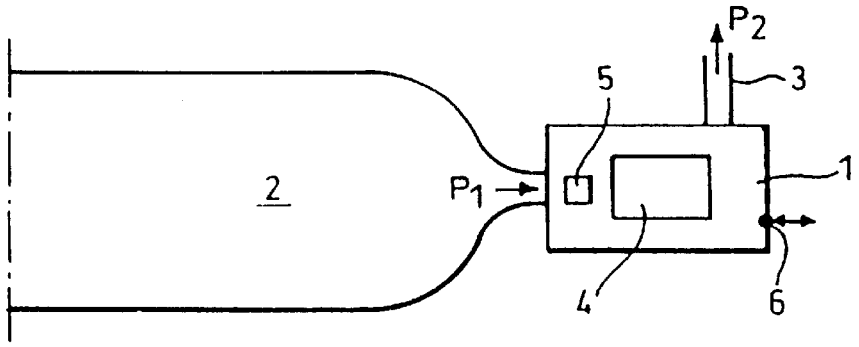
FIG. 1 shows schematically a gas regulator attached to a gas canister.

FIG. 1 shows schematically a gas regulator 1 attached to a gas canister 2. The regulator receives gas from the canister at an input pressure $P_1$ and provides regulated gas at a controlled output pressure $P_2$ through outlet 3. In preferred embodiments of the invention, this outlet is connected to the gas input of a paintball gun (not shown) or other pneumatically controlled projectile firing apparatus. The gas pressure is used to fire paintballs in known manner.

The regulator 1 is provided with an electronic display 4 which is most preferably an LCD display. This can be used to display various types of information relevant to the regulator and its final use. Thus, the regulator includes means for monitoring various parameters and for displaying values relative to these on the display 4. The monitored parameters may includes gas pressure within the tank, output pressure (i.e. the pressure of gas actually output to the paintball gun which is regulated) and temperature for example. By recording the number of shots fired by a paintball gun and monitoring the tank pressure, it is possible to calculate (and display) the approximate number of shots left in the tank. This figure may be improved by deducting the output pressure, since this represents the 'residual' pressure which must remain in the tank for it to supply sufficient gas for an associated paintball gun to fire a shot. A temperature monitor is also desirably provided, since temperature is of course, an important parameter in determining the amount of gas left in the tank. The display may also indicate a current mode of operation, may include timers, audible or visual warning devices and so on. The display is preferably controlled via a control apparatus 5 which includes or receives input from one or more pressure transducers for measuring input and/or output pressure and processing means for calculating various parameters. Control apparatus 5 may also receive inputs from other detectors, sensors, etc.

One or more input/output connectors 6 such as RS232 link, and/or an infra-red link can be provided, to enable data to be uploaded to or downloaded from the regulator control 5.

The pressure, both input and output pressures, from gas cylinders and regulators are conventionally measured using simple mechanical devices. These can be bulky and not particularly accurate. In an aspect of the present invention, pressure transducers are used to measure pressure. These may be piezoelectric-type transducers or, in more preferred embodiments of the invention, are thick film type of devices, such as resistive bridge devices. These comprise a resistive bridge, such as a Wheatstone bridge, printed upon a ceramic or metal disc. These type of devices are known in themselves but have not been used previously for gas regulators for paintball gun application. They have up to now been typically used for process control such as in chemical processes.

A preferred structure is of a Wheatstone bridge printed upon a metal disc, since a metal disc tends to be more resistant to shock, which is an important consideration in an environment such as a paintball game one where the gas cylinder and paintball gun are carried by the person and may be dropped or struck, and due to the nature of a rapid pressure pulse that is generated each time the paintball gun is fired.

Figure 2:
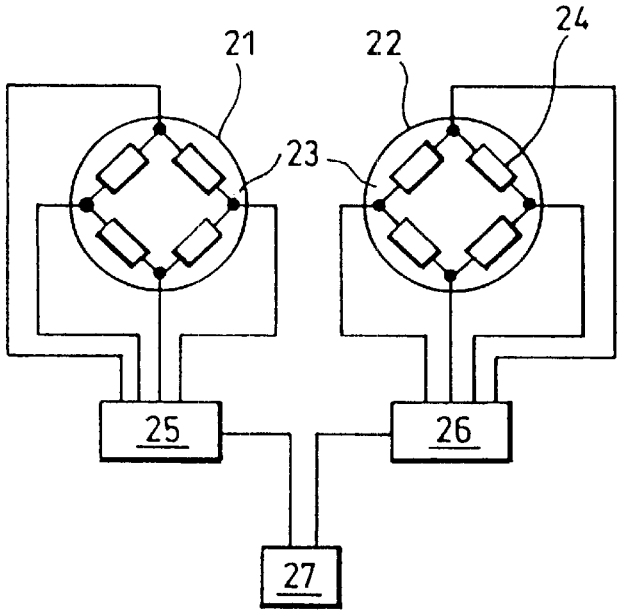
FIG. 2 shows a pair of pressure transducers for measuring input and output pressure.
Figure 3:
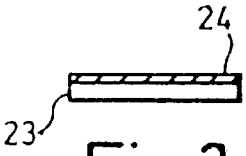
FIG. 3 shows a cross-section through a pressure transducer.

FIGS. 2 and 3 show an embodiment of pressure transducers for measuring input and output pressure of a regulator. A pair of thick film type pressure transducers 21 and 22 are provided which are positioned in the regulator such that transducer 21 can measure input pressure and transducer 22 can measure output pressure. Typically, they are positioned so that a branch from the relevant gas source is applied to the transducer. Each transducer 21 or 22 comprises a substrate in the form of a metal or ceramic disc 23 (FIG. 3) with a resistive electrical circuit 24 printed upon it. Typical circuits are shown schematically in FIG. 2. Outputs are taken from the Wheatstone bridge in normal manner to processing circuits 25, 26 and outputs from these, representative of sensed pressures (or pressure differences) are compared at a comparing circuit 27 which can measure the difference between input and output pressures. Outputs may also be taken direct from circuits 25 and 26 to a display such as LCD display 4 to directly indicate input and output pressures.

Piezo-type pressure transducers may alternatively be used, as may other types of pressure transducers.

The advantage of pressure transducers is that they are small, relatively unshockable and do not have moving parts or mechanisms which are prone to breakage and inaccuracy.

FIGS. 4*a* to 4*e* show views from various sides through a gas regulator incorporating various aspects of the invention. Each successive figure is rotated through 90 from the preceding one.

The regulator includes an input 41 for input gas at cylinder pressure and an output 42 through which the regulated gas at the desired output pressure is applied to a paintball gun for example. A regulator piston 43 is acted upon by an output adjuster 44 to alter the desired output pressure. Output adjuster 44 comprises a collar which threadedly connects with the body 45 of the regulator and, as it is screwed inwards (rightwards in the figure) exerts greater pressure upon one or more springs 46 which in turn increases the pressure upon the regulator piston.

The regulator also comprises a pressure compensated piston 47 which is acted upon by input gas from inlet 41 and also regulated gas 42*a* in such a manner as to compensate for pressure variation as will be described further below.

The regulator further comprises a main seal 48, a power supply in the form of one or more batteries, either conventional or rechargeable batteries 49, an LCD display 50, one or more function buttons 51 for controlling the display and an LED 52 or other visual indicator.

Two pressure transducers 53 and 54 for measuring, respectively, input and output pressure are connected by appropriate wiring 55 to a control circuit mounted upon a printed circuit board 56. A further printed circuit board 57 is used to provide further control and monitoring functions.

Most preferably, a display window is provided which is not shown for clarity in the figure.

As shown, input gas 41*a* enters through inlet nozzle 41 and is passed through a series of conduits 58. Specifically, the input gas 41*a* passes through conduit 58 into a cylinder 59 within which compensating piston 47 is coaxially mounted. A branch 60 is taken from here to first transducer 53 for measuring input pressure. As shown, the transducer is contained in a cylindrical container for convenience.

The output gas 42*a,* at a pressure determined by the regulator piston 43 and output adjuster 44, is fed via a branch 61 to second transducer 54 for measuring output pressure. The output gas acts, via main seal 48, against the front surface of compensated piston 47. Also, by means of a series of conduits 62, the output gas is applied directly to the rear end 63 of the compensating piston. Thus, the output pressure acts equally against the front and rear ends of the compensating piston.

By having such an equilibrium force on the piston 47 they cancel each other out so as the bottle pressure changes the force on the piston is constantly cancelled out, otherwise the force on the piston can be from zero to infinity. This force traditionally is applied to the main seal which can have compression to ensure it seals against lower pressure but against high pressure it would tend to creep or collapse. This would give variable output pressure as the main input pressure changes (the objective is to keep a constant output). The addition of the spring 70 that is acting on the piston is to provide a constant force irrespective of bottle pressure on to the seal so that it is biased to close the piston to seat. The spring can be removed but it is then desirable to change the ratio of force on each side of the piston, which would also ensure the seal is not exposed to excessive force.

The electronics monitoring and detection circuitry can be used to provide various sorts of displays on the display 50. These can include the regulator output and regulator input (tank) pressure, typically shown in pounds per square inch (psi) in the UK and USA. It may also display the number of shots left, by calculating the amount of gas used and thereby the amount of gas left in the tank and knowing the approximate volume of gas required for one shot by an attached paintball gun. The particular mode of operation, a timer function and many other functions may also be displayed. In the preferred embodiment, the display also includes a battery level icon 64 for indicating the amount of charge left in the battery. An LED 52 may be used to provide certain types of warning or other information and the function button 51 may be used to select between the various types of information which can be displayed.

Figure 5:
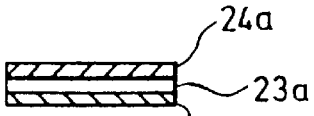
FIG. 5 shows a cross-section through a double-sided transducer arrangement.
Figure 4A:
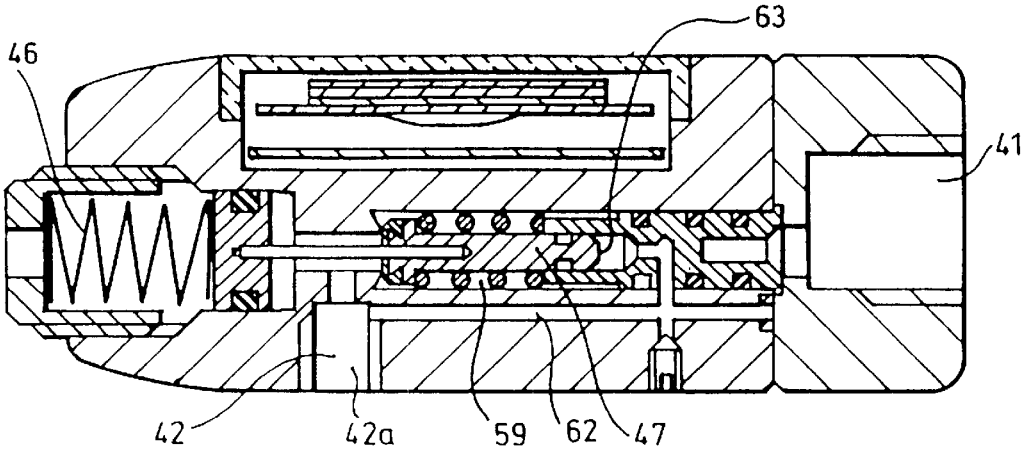
FIGS. 4*a* to 4*e* show cross-sections through a gas regulator.
Figure 4B:
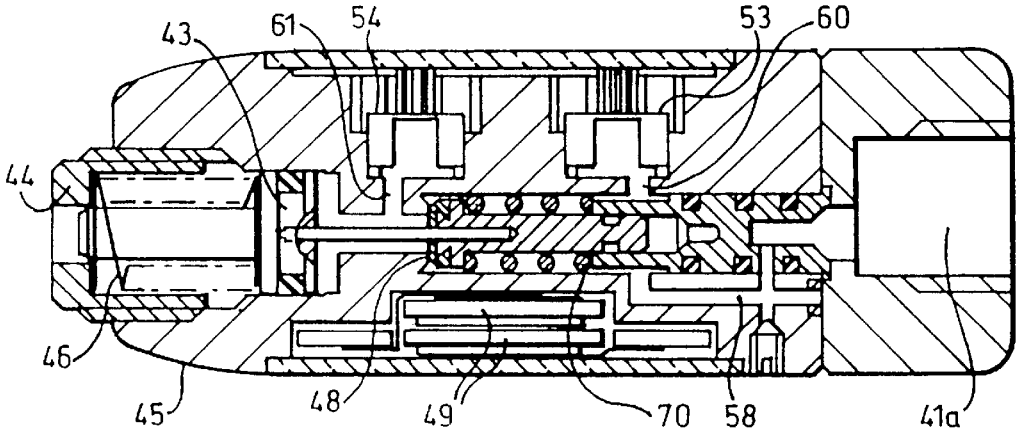
Figure 4C:
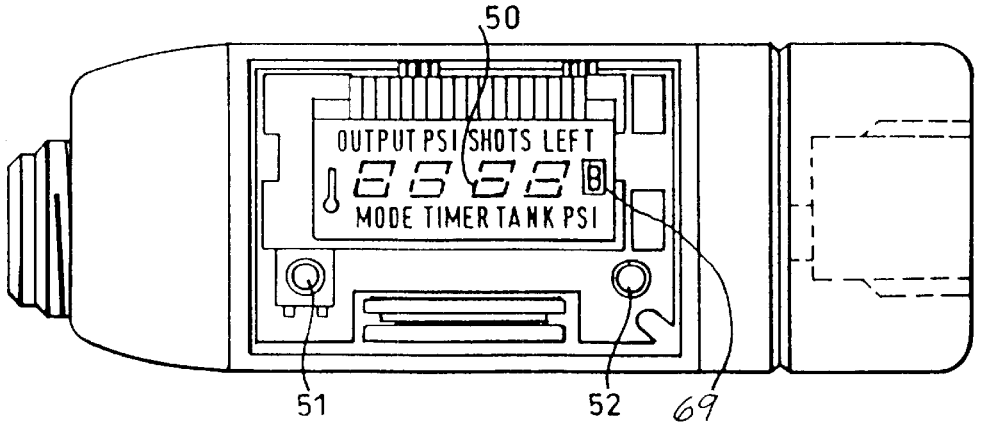
Figure 4D:
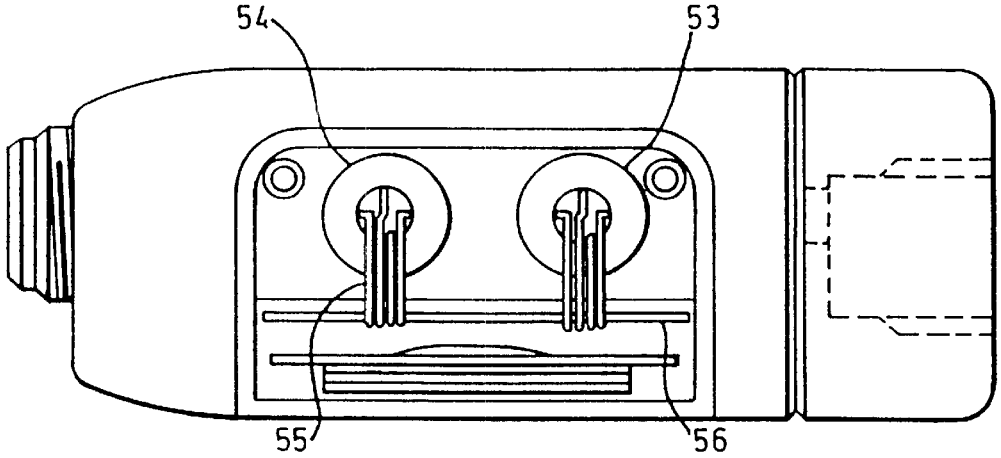
Figure 4E:
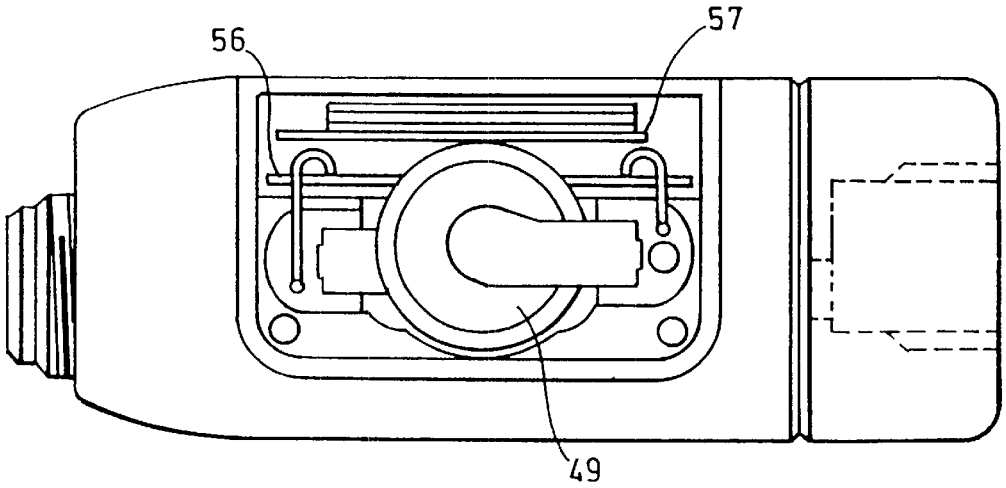

In an alternative embodiment, the two transducers are mounted onto a single disk 23*a* with a first transducer 24*a* printed upon a first face and a second transducer 24*b* printed upon the opposite face, as shown schematically in FIG. 5. Input and output gas can then be applied appropriately to the two faces, and appropriate electrical, connections made.

Figure 6:
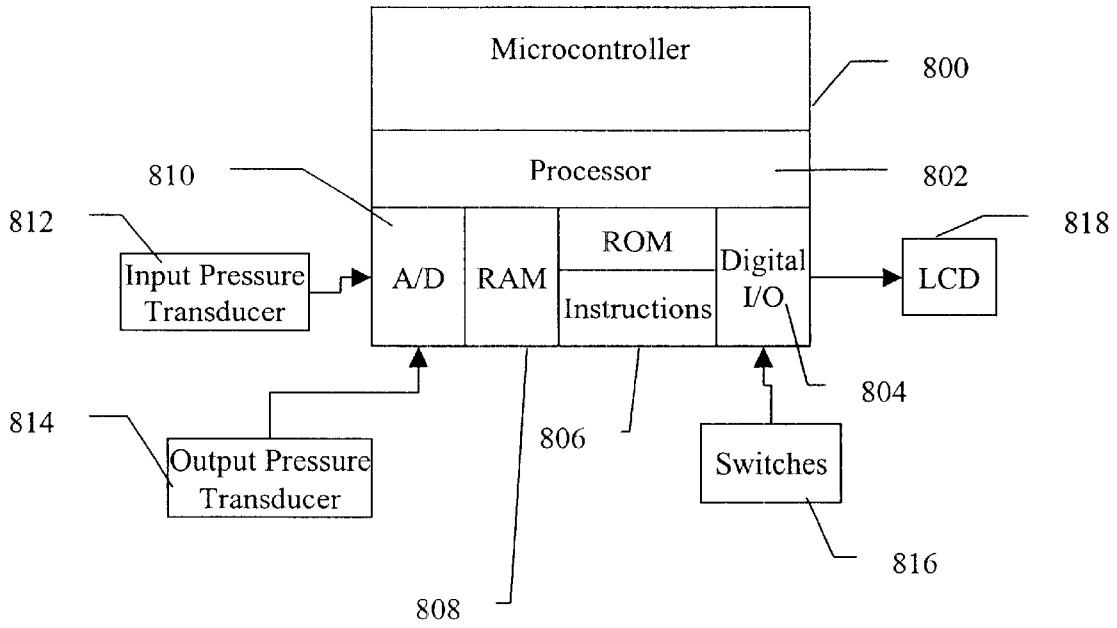
FIG. 6 is a block diagram of an embodiment of a control circuit useful for adding advanced functions to the pressure regulator.

FIG. 6 is a block diagram of an embodiment of a control circuit useful for adding advanced functions to the pressure regulator. The control circuit comprises a microcontroller 800 operably coupled to the previously described LCD screen 818, user input switches 816, the previously described input pressure transducer 812, and the previously described output pressure transducer 814.

The microcontroller comprises a processor 802 operably coupled to a digital Input Output (I/O) port 804, a Read Only Memory (ROM) 806 including programming instructions encoding regulator functions 807, Random Access Memory (RAM) 808, and an Analog to Digital (A/D) conversion circuit 810.

The processor uses the I/O port to receive digital user command signals from the user switches. The user command signals direct the processor to implement the advanced features of the regulator.

The processor uses the I/O port to transmit digital display control signals to the LCD screen. The display control signals comprise the processor's response to the received user command signals and drive the LCD screen.

The processor uses the A/D conversion circuit to receive analog signals from the pressure transducers and convert those analog signals into digital pressure signals for processing according to the programming instructions.

In operation, the processor retrieves the programming instructions from the ROM and begins to execute the programming instructions to implement various advanced regulator functions in response to user commands received from the user via the user switches.

An exemplary embodiment of an advanced regulator feature is a "shots remaining" feature. A shots remaining signal is generated by a microcontroller processor operably coupled to a pressure regulator using input and output pressure signals combined with a shots remaining calibration constant. The shots remaining signal is an approximation of the number of shots a user can expect to get out of a paintball gun based on the gas pressure in a gas cylinder coupled to the paintball gun.

A shots remaining calculation is based on a shots remaining calibration constant determined by firing a series of paintballs during a given time period until a specific pressure drop is reached within the gas supply cylinder. The number of paintballs fired and the pressure drop is used to determine a shots remaining calibration constant.

Figure 7:
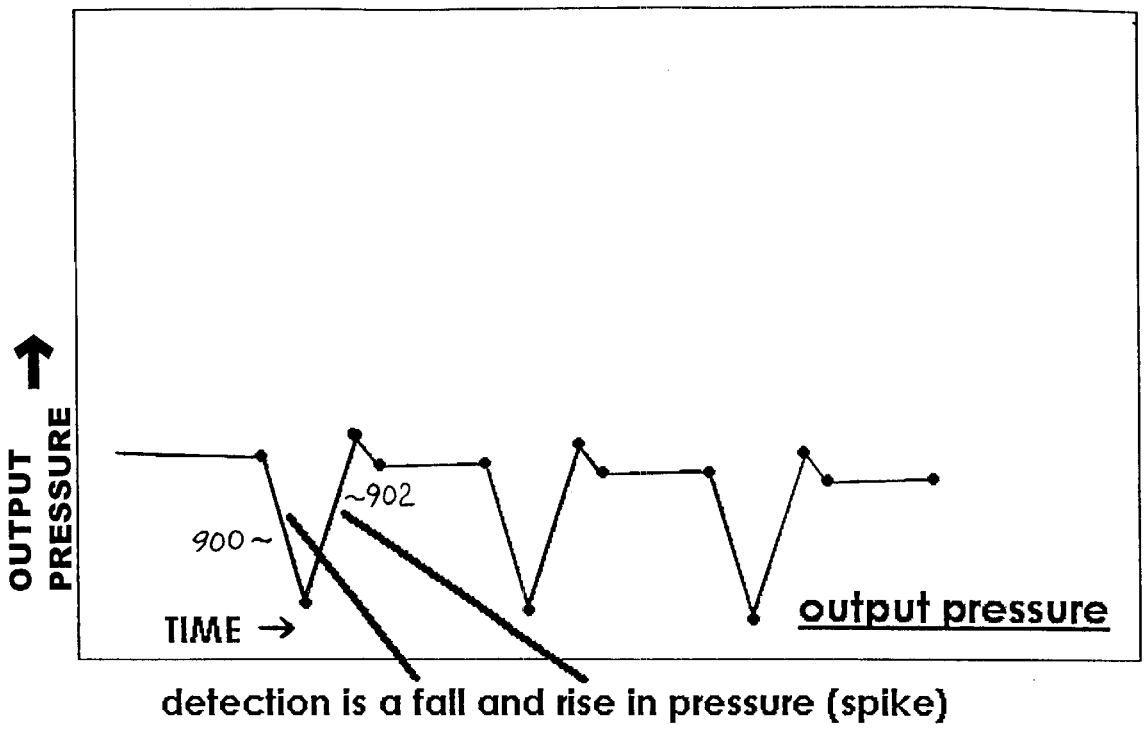
FIG. 7 is a graphic illustration of an embodiment of a "shots fired" detection algorithm as used by a microcontroller processor operably coupled to a pressure regulator via an output pressure transducer.

FIG. 7 is a graphic illustration of an embodiment of a "shots fired" detection algorithm as used by a microcontroller processor operably coupled to a pressure regulator via an output pressure transducer. The processor receives output pressure signals from the output pressure transducer and looks for a rapid drop 900 in regulator output pressure followed by a substantially equal and rapid rise 902 in the output pressure as the pressure regulator attempts to reestablish the output pressure. The combination of the rapid fall and rise in output pressure, also referred to as a pressure spike or pressure pulse, denotes a paintball being fired from the paintball gun.

A shots remaining calibration constant is calculated using the following equation:

$$Ns=Nk/Pd*Fc$$

Where:

Ns=shots remaining calibration constant (in shots/psi);

Nk=Number of shots fired for the specified pressure drop (in shots);

Pd=Specified pressure drop (in psi); and

Fc=thermal compensation factor (dimensionless).

The thermal compensation factor is an empirically derived constant used to account for thermal effects that cannot be directly calculated unless a temperature transducer is used in combination with the pressure regulator. In another embodiment of a pressure regulator, a temperature transducer is used and the thermal compensation factor is calculated directly during a calibration procedure.

Figure 8:
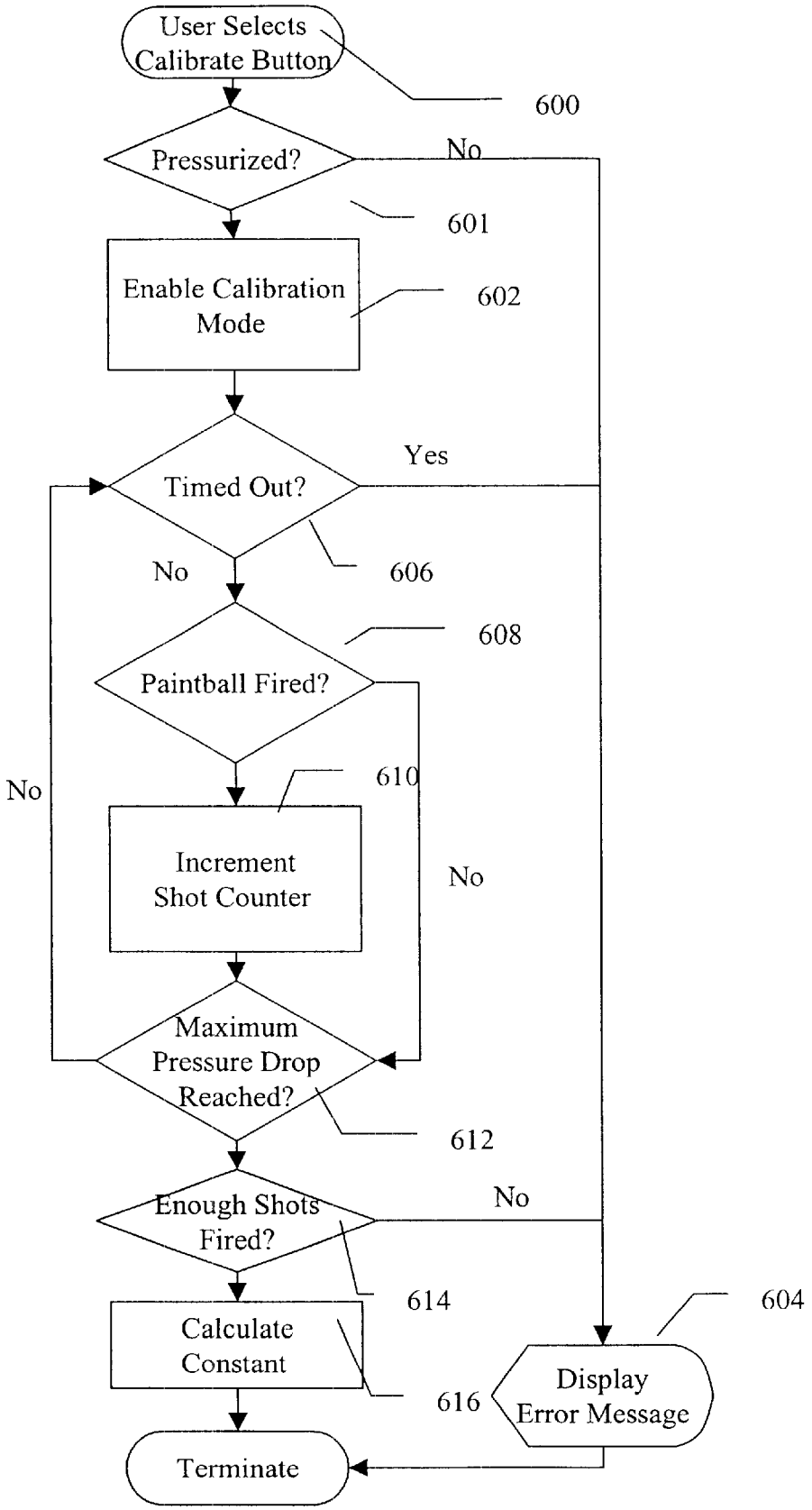
FIG. 8 is process flow diagram illustrating an embodiment of a shots remaining calibration procedure for determining a shots remaining calibration constant used by a microcontroller processor operably coupled to a pressure regulator.

FIG. 8 is process flow diagram illustrating an embodiment of a shots remaining calibration procedure for determining a shots remaining calibration constant used by a microcontroller processor operably coupled to a pressure regulator.

A user adjusts the pressure regulator so that the paintball gun delivers paintballs at a desired velocity. The user selects a calibration switch 600 to initiate a calibration procedure. The processor receives pressure signals from an input and output pressure transducer and determines 601 if there is enough pressure in the tank and pressure supplied by the regulator to conduct the calibration procedure. If there is not enough pressure on either the input or output of the regulator, the processor displays an error message 604 and terminates the calibration procedure.

If there is enough pressure on the input and output of the regulator, the processor enables the calibration mode 602 and begins timing the calibration procedure 606. The processor determines if the calibration procedure has timed out 606 and displays an error message 604 before terminating the calibration procedure. In one embodiment of a pressure calibration procedure according to the present invention, the user is given 30 seconds to shoot paintballs.

If a paintball shot is detected 608, then a shot counter is incremented 610. The processor checks to see if the specified pressure drop has been achieved 612. If the specified pressure drop has not been achieved, the processor checks to see if the calibration procedure has timed out 606 and continues to loop waiting for paintballs to be shot.

If the specified pressure drop has been achieved, the processor determines 614 if enough paintballs have been shot to generate an accurate shots remaining calibration constant. If not, the processor displays an error message 604 and terminates.

If the processor determines that enough paintballs have been shot to generate an accurate shots remaining calibration constant, the processor generates and stores a shots remaining calibration constant 616 and terminates.

In one embodiment of a gas regulator according to the present invention, the shots remaining calibration constant is automatically recalculated without user intervention each time the pressure in the gas cylinder drops by the specified pressure drop during normal operation of the paintball gun. In this embodiment, the number of shots fired is constantly monitored for each incremental drop in the gas cylinder so that the number of shots fired can be used to recalculate the shots remaining calibration constant.

In one embodiment of a gas regulator according to the present invention, a user enters into the gas regulator the number of shots fired during the calibration procedure.

In one embodiment of a gas regulator according to the present invention, a shots fired signal is received from a sensor outside of the gas regulator such as a shot fired sensor mounted on the paintball gun.

The shots remaining calibration constant is used in the following manner to calculate the number of shots remaining:

$$Nr=Ns*(Pi-Po)$$

Where:

Nr=number of shots remaining (in shots);

Ns=shots remaining calibration constant (in shots/psi);

Pi=input pressure to pressure regulator (in psi); and

Po=output pressure from pressure regulator (in psi).

Several observations lead to a simplified shots remaining calculation suitable for use in a microcontroller. One such observation is that engineering units do not need to be used to describe the input pressure, output pressure. and specified pressure drops. Instead, the un-scaled digital A/D output signals corresponding to the analog pressure transducer pressure signals can be used for internal representation of the pressure signals.

Additionally, differences between the ranges of the pressure transducers can be compensated by using a simple correction factor. In one embodiment of a gas regulator employing pressure transducers according to the present invention, the ranges of the pressure transducers are selected based on the design input and output pressures of the gas regulator. In this embodiment, the controlled output pressure is substantially lower than the input pressure. Therefore, the output pressure transducer's range is chosen to be substantially less than the range of the input transducer. For example, if the expected gas cylinder pressure is around 4500 psi then an input pressure transducer may be selected with an operating range of 0 to 9000 psi with an maximum allowable pressure limit of 18000 psi. If the maximum expected output pressure is around 1100 psi, then an output pressure transducer may be selected with a range of 0 to 2250 psi and a maximum allowable pressure of 4500 psi. In this case, the output pressure transducer's pressure signal will be 4 times the input pressure transducer's pressure signal for the same applied pressure.

In one embodiment of a gas regulator employing pressure transducers according to the present invention, a microcontroller uses an 8 bit AID conversion circuit, an input pressure transducer and processing circuit combination has an operational a range of 0 to 5600 psi and an output pressure transducer and processing circuit combination has an operational range of 0 to 1400 psi and a specified pressure drop during calibration is 176 psi. The 8 bit A/D converter generates 0–255 unique values or D/A increments over its entire range. In this case, the input pressure transducer pressure signal will fall within the range of 0–255 D/A increments, the compensated output pressure transducer pressure signal will fall within the range of 0–255/4 D/A increments, and the specified pressure drop is 8 D/A increments.

Substituting the above values into the previous equations yields the following two equations:

$$Ns=Nk/8*Fc$$

Where:

Ns=shots remaining calibration constant (in shots/D/A increment);

Nk=number of shots fired for the specified pressure drop of 8 D/A increments (in shots); and Fc=thermal compensation factor (dimensionless).

$$Nr=Ns*(Di-Do/4)$$

Where:

Nr=number of shots remaining (in shots);

Ns=shots remaining calibration constant (in shots/D/A increments);

Di=input pressure to pressure regulator (in D/A increments); and

Do=output pressure from pressure regulator (in D/A increments).

In some embodiments only a single pressure transducer (piezo, thick film, etc) is required. Since a sudden release of gas creates a shockwave, the resulting shockwave (i.e. spike) can be measured by a single transducer and the spikes can be counted to provide an indication of the number of shots fired. For this embodiment, it is preferred to use a single transducer at the regulator inlet so that total tank pressure may still be monitored. In this embodiment, the regulator output pressure may either be estimated as a constant, or the value may be entered by the user.

Figure 9:
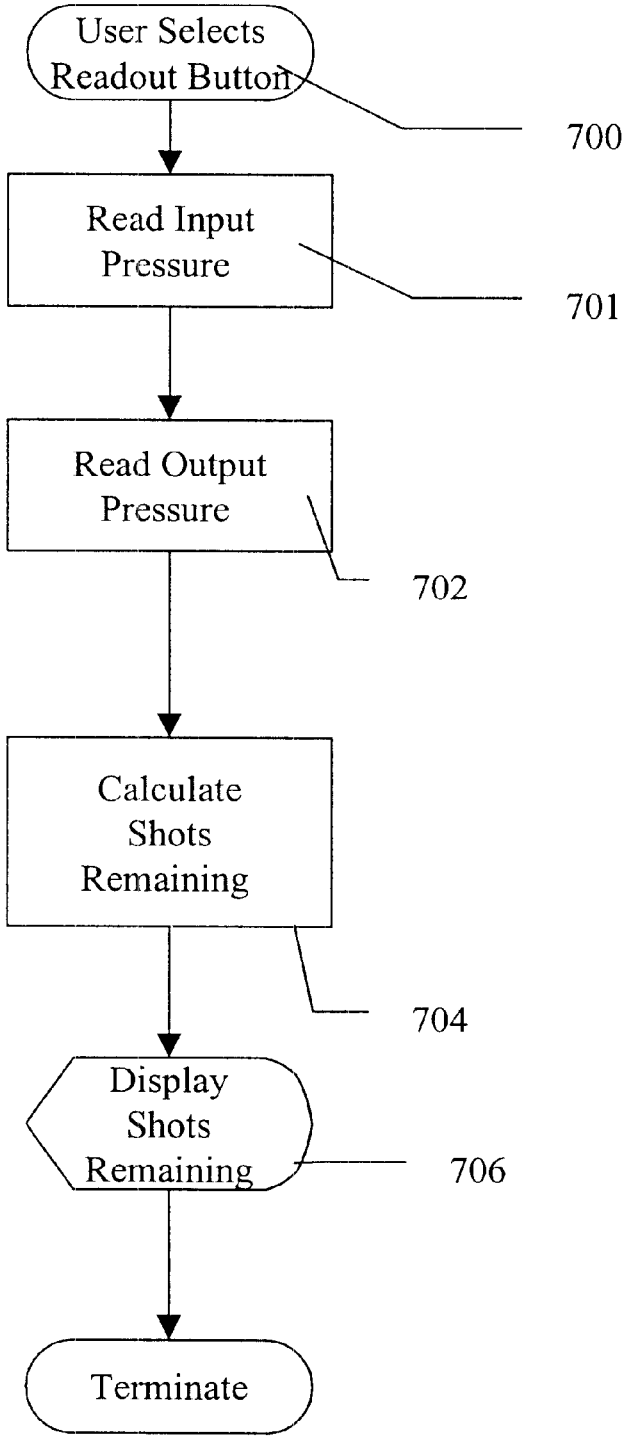
FIG. 9 is a process flow diagram illustrating an embodiment of a shots remaining calculation process as used by a microcontroller processor operably coupled to a pressure regulator via an input pressure transducer.

FIG. 9 is a process flow diagram illustrating an embodiment of a shots remaining calculation process as used by a microcontroller processor operably coupled to a pressure regulator via an input pressure transducer. A user selects a shots remaining readout button 700 and the processor receives an input pressure signal 701 and an output pressure signal 702 from the gas regulator. The processor uses the input pressure signal and the output pressure signal in combination with a shots remaining calibration constant to calculate the number of shots remaining 704. The process generates a shots remaining display signal and transmits the shots remaining signal to the previously described LCD screen 706.

In the preferred embodiment, it is also desired that an energy conservation feature be included such that any unused electronics such as the transducers are powered down when not in use. This can significantly prolong the battery life for the regulator and permits the use of compact coin cell batteries. If such an energy conservation feature is included, appropriate time delays on the order of 0.3 to 0.5 seconds may need to be added to the algorithms.

Although this invention has been described in certain specific embodiments, many additional modifications and variations would be apparent to those skilled in the art. Certain features of the present invention may also be used in combination with other paintball guns and regulators, particularly those illustrated in U.S. patent application Ser. Nos. 09/272,652, 09/418,224, 09/418,225, and 09/607,838, all of which are incorporated herein by reference.

It is therefore to be understood that this invention may be practiced otherwise than as specifically described. Thus, the present embodiments of the invention should be considered in all respects as illustrative and not restrictive, the scope of the invention to be determined by claims supported by this application and the claim's equivalents rather than the foregoing description.

What is claimed is:

1. A gas regulator for a compressed gas powered projectile firing device adapted to generate a shots remaining signal, the gas regulator comprising:

a pressure transducer; and a microcontroller operably coupled to the pressure transducer, the microcontroller including:

a processor; and a memory operably coupled to the processor and having program instructions stored therein, the processor being operable to execute the program instructions, the program instructions including:

receiving first and second calibration gas pressure signals from the pressure transducer;

receiving a shots fired signal;

receiving a gas input pressure signal from the pressure transducer; and generating a shots remaining signal from the first and second calibration gas pressure signals, the gas input pressure signal, and the shots fired signal.

2. The gas regulator of claim 1, the program instructions further including:

receiving a calibration gas temperature signal; and generating a temperature compensated shots remaining signal using the calibration gas temperature signal, the first and second calibration gas pressure signals, the gas input pressure signal, and the shots fired signal.

3. The gas regulator of claim 2, the program instructions further including:

receiving a gas temperature signal; and generating a temperature compensated shots remaining signal using the gas temperature signal, the calibration gas temperature signal, the first and second calibration gas pressure signals, the gas input pressure signal, and the shots fired signal.

4. The gas regulator of claim 1, wherein the number of shots fired signal is determined by counting pressure spike signals received from the gas pressure transducer.

5. The gas regulator of claim 1, wherein the shots fired signal is generated for a specified gas pressure drop.

6. The gas regulator of claim 1, wherein the shots fired signal is received from a user.

7. The gas regulator of claim 1, wherein the shots fired signal is received from a shot fired sensor.

8. A gas regulator for a compressed gas powered projectile firing device adapted to generate a shots remaining signal, the gas regulator comprising:

an input pressure transducer;

an output pressure transducer; and a microcontroller operably coupled to the input pressure transducer and the output pressure transducer, the microcontroller including:

a processor; and a memory operably coupled to the processor and having program instructions stored therein, the processor being operable to execute the program instructions, the program instructions including:

receiving a first and second calibration gas pressure signal from the input pressure transducer;

receiving a shots fired signal;

receiving a gas output pressure signal from the output pressure transducer;

receiving a gas input pressure signal from the input pressure transducer; and generating a shots remaining signal from the first and second calibration gas pressure signals, gas input pressure signal, gas output pressure signal, and the shots fired signal.

9. The gas regulator of claim 8, the program instructions further including:

receiving a calibration gas temperature signal; and generating a temperature compensated shots remaining signal using the calibration gas temperature signal, the first second calibration gas pressure signals, gas input pressure signal, gas output pressure signal, and the shots fired signal.

10. The gas regulator of claim 9, the program instructions further including:

receiving a gas temperature signal; and generating a temperature compensated shots remaining signal using the gas temperature signal, the calibration gas temperature signal, the first and second calibration gas pressure signals, gas input pressure signal, gas output pressure signal, and the shots fired signal.

11. The gas regulator of claim 8, wherein the shots fired signal is determined by counting pressure spike signals received from the output gas pressure transducer.

12. The gas regulator of claim 8, wherein the shots fired signal is generated for a specified gas pressure drop.

13. The gas regulator of claim 8, wherein the shots fired signal is received from a user.

14. The gas regulator of claim 8, wherein the shots fired signal is received from a shot fired sensor.

* * * * *